United States Patent [19]

Rozzi

[11] 4,125,355

[45] Nov. 14, 1978

[54] SAFETY CONTROL SYSTEM FOR GAS-FIRED INFRARED RADIANT HEATER

[75] Inventor: Mario Rozzi, St. Clair Shores, Mich.

[73] Assignee: Detroit Radiant Products Company, Detroit, Mich.

[21] Appl. No.: 823,667

[22] Filed: Aug. 11, 1977

[51] Int. Cl.[2] ..... F23H 5/02

[52] U.S. Cl. ..... 431/71; 431/73; 431/74

[58] Field of Search ..... 431/46, 69, 71, 73, 431/74

[56] References Cited

U.S. PATENT DOCUMENTS

| | | | |
|---|---|---|---|
| 3,062,276 | 11/1962 | Miller et al. | 431/46 |
| 3,114,410 | 12/1963 | Schneider | 431/328 |
| 3,204,685 | 9/1965 | Patrick | 431/71 |
| 3,845,582 | 11/1974 | Capy | 431/46 |

*Primary Examiner*—Carroll B. Dority, Jr.
*Attorney, Agent, or Firm*—Whittemore, Hulbert & Belknap

[57] ABSTRACT

The safety control system is adapted for use in connection with a gas-fired infrared radiant heater which employs a pilot for ignition thereof. The system will cause the supply of gas to be discontinued to both the heater and pilot after a suitable time interval in the event that ignition of the pilot does not occur.

4 Claims, 3 Drawing Figures

SAFETY CONTROL SYSTEM FOR GAS-FIRED INFRARED RADIANT HEATER

BACKGROUND OF THE INVENTION

In the past, control devices for natural gas fired infrared heaters which have pilot burners have required shut off of only the supply of gas to the heater in event of failure of ignition. The gas supply has continued to flow to the pilot and released therefrom to the ambient. This small amount of gas has been considered harmless, particularly since it is lighter than air and flows upwardly.

However, local or state government regulations have required that both the heater and pilot gas supply be cut off after failure of ignition for a predetermined time. In the gas of propane gas, which is heavier than air, the time specified is ninety seconds.

The present invention provides a control system which will safely satisfy such regulations.

SUMMARY OF THE INVENTION

The safety control system for a gas-fired infrared radiant heater includes a gas-fired infrared radiant heater having one open face composed of perforated ceramic tile structure. Means are provided for supplying a burnable air/gas mixture through said perforations for burning on said open face to heat the tile structure for emission thereof of infrared radiant heat. A pilot burner is provided adjacent to the open face for igniting the air/gas mixture of the heater. Means are provided for supplying a burnable air/gas mixture to the pilot burner. Electrically operated ignition means are provided adjacent to the pilot burner for igniting the pilot. Temperature responsive means are provided adjacent to the pilot burner for detecting ignition of the pilot. First switch means are operably connected to the temperature responsive means and actuatable thereby to close when the pilot burner goes out and to open when the pilot burner is ignited. An electrically operated solenoid valve is operably connected between the means for supplying the burnable air/gas mixture to the heater and pilot burner. Electrical power means are connected to the solenoid valve. Second switch means are connected between the power means and the solenoid valve. A time delay device is connected between power and the first switch means. The time delay device is operative to cause actuation of the second switch with resultant closing of the solenoid valve after a predetermined time interval subsequent to closure of the first switch and failure thereof to reopen to thereby discontinue the flow of gas to the heater and pilot burner.

IN THE DRAWING

Figure 1:
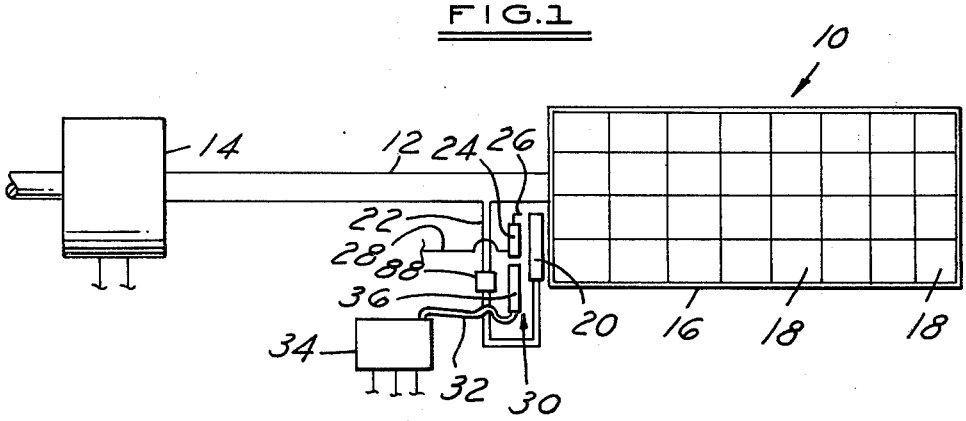
FIG. 1 is a diagrammatic view of the physical layout of the safety control system for gas-fired infrared radiant heater in accordance with one embodiment of the present invention.

Referring to FIG. 1, it will be noted that a gas-fired infrared heater 10 is supplied with gas via conduit 12. Conduit 12 is connected to a source of burnable gas under pressure (not shown). Flow of gas through conduit 12 is controlled by valve 14. Valve 14 is caused to open and close by means of a solenoid.

The heater 10 comprises a casing 16 which mounts a plurality of ceramic tiles 18 which define a face. The tiles 18 have perforations therethrough and are composed of a material which, when heated to an incandescence, will emit infrared radiation for heating purposes. The tiles may be constructed in accordance with U.S. Pat. No. 2,775,294 issued to Gunther Schwank, or in accordance with other compositions and constructions commercially available on the market. In operation of such tiles, the gas/air mixture which is formed in casing 16 behind the tiles, flows through the tile perforations and burns as it leaves the holes. The burning takes effect at the surface of the tiles, thus heating the tiles to incandescence. Air is introduced into casing 26 along with the gas.

A pilot 20 is provided adjacent the outer faces of the tiles 18. The pilot is fed with a small amount of gas by conduit 22 which extends from main conduit 12. When gas flows through pilot 20 and is ignited, the resultant flame is operative to ignite the gas emitted from tiles 18 and thereby cause the desired heating of the tiles. So long as the pilot is lit, it will cause ignition or reignition of the tiles gases in the event that burning is extinguished, as may be caused, for example, by a strong air draft. There are various pilot constructions which severly limit extinguishing the pilot flame even during conditons which may cause the tile gas flames to be extinguished. As will be appreciated from the necessary open face of the heater, it is not possible to shield it. It will therefore be appreciated, so long as the pilot flame burns, the unit will operate safely.

With this in mind, the function of the electrical control system may be understood. The control system has two functions. One is to attempt to cause ignition of the pilot flame whenever it is extinguished. The second is to discontinue flow of gas to the system if the pilot remains unlit for a specified time period. For example, one regulation requires that the control system shut off the gas supply if the pilot remains unignited for a period of ninety seconds when propane is used as the fuel.

The means for igniting the pilot flame in FIG. 1 is a spark igniter 24. The igniter 24 is located adjacent to the pilot 20. The igniter has an electrode 26 which is located close to pilot 20 which serves as a grounded electrode. The electrode 26 is connected to a source of electrical power by a lead 28. When power is applied, a spark will jump between the electrodes causing ignition of the pilot flame.

A flame detector 30 is provided adjacent the pilot 20 to detect ignition of the pilot. If the pilot flame is not lit, the detector 30 will sense the drop in temperature and will send a signal via mercury filled conduit 32 to a control switch 34. The control switch will, in turn, cause reignition of the pilot flame. Upon failure of ignition within a preselected time, the solenoid of valve 14 will be actuated to close valve 14 and shut off the supply of gas to both the heater 10 and pilot 20.

The detector 30 is of the mercury type. A chamber in body 36 is filled with mercury as is conduit 32 which is in fluid communication therewith. The conduit 32 is operably connected to switch 34. When the pilot flame is lit, the mercury in body 36 is heated with resultant expansion. This cause switch arm 38 to move to the open dotted line position shown in FIG. 2, the switch 34 being mechanically opened and closed by the expansion and contraction of the mercury. When the mercury cools and contracts, switch arm 38 is moved to the solid line position of FIG. 2 thereby closing the switch.

Figure 2:
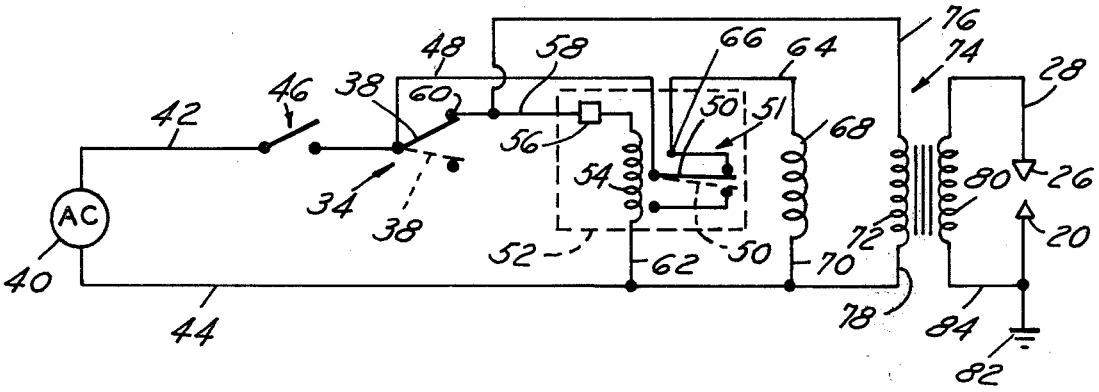
FIG. 2 is an electrical schematic view of the control system of FIG. 1.

Referring to FIG. 2, the circuit thereshown includes a source of power 40 from which extend leads 42, 44. A switch 46, normally controlled by a thermostat, is provided in lead 42. Lead 42 is connected to switch arm 38. Lead 48 extends therefrom into connection with switch arm 50 of relay 51, which forms part of time delay device 52. Switch arm 50 is held in the solid line closed position so long as coil 54 is not energized. Upon energization of coil 54, switch arm 50 is moved to the dotted line position thus opening the switch.

A time delay mechanism 56 is provided in lead 58 which extends from contact 60 of switch 34 to one side of coil 54. The other side of the coil is connected to lead 44 via lead 62.

Lead 64 extends from contact 66 to one side of coil 68. The coil 68 is the coil of the solenoid of valve 14. The other side of coil 68 is connected to lead 44 via lead 70.

The primary winding 72 of step-up transformer 74 is connected to leads 58, 44 via leads 76, 78. One side of secondary winding 80 is connected to igniter electrode 26 via lead 28. The other side of the winding 80 is connected to ground 82 via lead 84.

Operation of the control system may now be understood. When the pilot flame is lit, switch arm 38 is in the dotted line position. Coil 68 is energized and valve 14 open. Fuel flows to heater 10 and pilot 20.

Should the flame of pilot 20 be extinguished, detector 30 will cause, after a short time delay, switch arm 38 to move to close switch 34. Closure of switch 34 applies power to igniter 24 and time delay mechanism 56. Should the pilot fail to ignite and thereby cause detector 30 to open switch 34 within 45 seconds, time delay mechanism 56 will close the circuit through coil 54 thereby causing switch arm 50 to move to the dotted line position. This opens the circuit between coil 68 and power thereby causing valve 14 to close and discontinue flow of fuel to heater 10 and pilot 36. In order to attempt restart of the system, it is necessary to open switch 46 whereupon time delay mechansim 56 will be deactivated. Upon subsequent closure of switch 46, the ignition cycle will again commence. Should ignition of pilot 20 be accomplished, detector 36 will cause switch 34 to open thus relieving time delay mechanism 56 of power and preventing energization of coil 54.

The 90 second time requirement previously mentioned is met by the combined times of the 45 second time delay plus the time required for detector 30 to cause initial closing of switch 34, this time being less than 30 seconds.

The electrode 26 may be provided with a flame detector which operates to open the electrical circuit through the electrode whenever the pilot is lit. The electrode may then be placed in parallel with the coil 68. In this way, an immediate pilot reignition attempt takes place for a period of the combined times of the 45 second time delay plus the time required for detector 30 to cause initial closing of switch 34. The electrode 26 and the solenoid valve 14 will be denied power in the event that there is a failure of reignition of the pilot. Thus, the electrode will not continue to spark when there is no fuel flowing.

Figure 3:
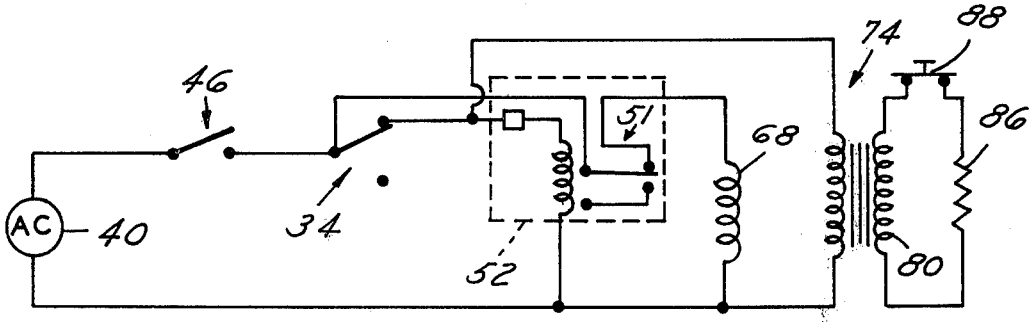
FIG. 3 is an electrical schematic view of a modified control system.

FIG. 3 illustrates the use of a glow-coil igniter 86 in place of electrode igniter 26. The circuit is otherwise the same. A glow-coil igniter is fabricated of resistive material and becomes hot when a current is passed therethrough. Such a coil reaches a temperature sufficient to cause ignition to the gas. The use of glow-coils are preferred in some instances.

A pressure operated switch 88 is placed in the secondary winding circuit. This switch is physically located in the pilot line 22. When gas stops flowing, which occurs upon closing of valve 14, the reduced pressure results in the contacts of switch 88 opening. Thus glow-coil 86 will not continue to be energized when gas is now flowing. The glow coil will burn out if energized for any prolonged period.

The components of the present control system are available as commercial products. For example, the switch 34 and associated detector 30 are available from the White Rodgers Company of St. Louis, Mo. (Model 3049-41). The same company makes available igniter electrode 24 (Model 760-502) and glow-coil 86 (Model 33-0344). The time delay device 52 is available from Omnetics, Inc., (Model MOR24A). Valve 14 is available from Minneapolis Honeywell (Model V844A-1078). Switch 88 is available from the Robertshaw Company (Model EY1). White Rodgers Company has available an electrode including flame detector (Model 760-502).

What is claimed is:

1. A safety control system for a gas-fired infrared radiant heater comprising a gas-fired infrared radiant heater having one open face composed of perforated ceramic tile structure, means for supplying a burnable air/gas mixture through said perforations for burning on said open face to heat the tile structure for emission thereof of infrared radiant heat, a pilot burner adjacent said open face for ingniting the air/gas mixture of the heater, means for supplying a burnable air/gas mixture to the pilot burner, electrically operated ignition means adjacent the pilot burner for igniting the pilot, temperature responsive means adjacent the pilot burner for detecting ignition of the pilot, first switch means operably connected to said temperature responsive means actuatable thereby to close when the pilot burner goes out and to open when said pilot burner is ignited, electrically operated solenoid valve means operably connected between the means for supplying a burnable air/gas mixture to the heater and pilot burner, electrical power means connected to said solenoid valve means, second switch means being connected between said power means and said solenoid valve, a time delay device connected between power and said first switch means, the time delay device being operative to cause actuation of said second switch means with resultant closing of said solenoid valve means after a predetermined time interval subsequent to closure of said first switch means and failure thereof to reopen to thereby discontinue the flow of gas to the heater and pilot flame.

2. A safety control system as in clain 1, further characterized in that said electrically operated ignition means is a sparking electrode.

3. A safety control system as in claim 1, further characterized in that said electrically operated ignition means is a glow-coil.

4. A safety control system as in claim 1, further characterized in the provision of means to deenergize the ignition means upon closing of said solenoid valve means.

* * * * *